US011207567B2

(12) United States Patent
Couzyn

(10) Patent No.: US 11,207,567 B2
(45) Date of Patent: Dec. 28, 2021

(54) MODULAR FIN WITH COMMON RAIL SYSTEM

(71) Applicant: Rhys James Couzyn, Ballito (ZA)

(72) Inventor: Rhys James Couzyn, Ballito (ZA)

( * ) Notice: Subject to any disclaimer, the term of this patent is extended or adjusted under 35 U.S.C. 154(b) by 0 days.

(21) Appl. No.: 16/964,129

(22) PCT Filed: Jan. 21, 2019

(86) PCT No.: PCT/IB2019/050487

§ 371 (c)(1),
(2) Date: Jul. 22, 2020

(87) PCT Pub. No.: WO2019/145842

PCT Pub. Date: Aug. 1, 2019

(65) Prior Publication Data

US 2021/0001183 A1 Jan. 7, 2021

(30) Foreign Application Priority Data

Jan. 24, 2018 (GB) ..... 1801154

(51) Int. Cl.
*A63B 31/11* (2006.01)

(52) U.S. Cl.
CPC ..... *A63B 31/11* (2013.01); *A63B 2031/112* (2013.01)

(58) Field of Classification Search
CPC ..... A63B 31/11; A63B 2031/112
USPC ..... 114/60, 61, 62, 63, 64
See application file for complete search history.

(56) References Cited

U.S. PATENT DOCUMENTS

| | | | |
|---|---|---|---|
| 6,672,920 | B2 | 1/2004 | Wilson |
| 7,159,336 | B2 | 1/2007 | Burns et al. |
| 2011/0065343 | A1 | 3/2011 | Hsu |
| 2017/0120110 | A1 | 5/2017 | Fujimoto |

FOREIGN PATENT DOCUMENTS

| | | | |
|---|---|---|---|
| CN | 206483074 | U | 9/2017 |
| DE | 102011112980 | A1 | 3/2013 |
| GB | 1048309 | A | 11/1966 |
| KR | 20070021354 | A | 2/2007 |
| WO | 01/78845 | A1 | 10/2001 |
| WO | 2001/078844 | A1 | 10/2001 |
| WO | 2011/123950 | A1 | 10/2011 |

*Primary Examiner* — Anthony D Wiest
(74) *Attorney, Agent, or Firm* — Jason P. Mueller; FisherBroyles, LLP

(57) ABSTRACT

A disclosed diver fin includes a blade and a foot pocket, distinct from one another and releasably connected to one another by one or more rails extending from a leading edge of the blade to the foot pocket. The rails extend from either side of the foot pocket and extend parallel to one another at least partway along the length of the blade towards a trailing edge of the blade. Each rail includes two sections: a first rail section, extending from the leading edge of the blade and terminating in a free end, and a second rail section, extending from the foot pocket and terminating in a free end. The free end of one rail section includes a female recess, and the free end of the other rail section terminates in a male extension, slidably receivable in the female recess. The disclosed fin is reconfigurable to accommodate different diving conditions.

4 Claims, 4 Drawing Sheets

MODULAR FIN WITH COMMON RAIL SYSTEM

CROSS REFERENCE TO RELATED APPLICATION

This application is a national stage entry under 35 U.S.C. 371 of PCT Patent Application No. PCT/IB2019/050487, filed Jan. 21, 2019, which claims priority to United Kingdom Patent Application No. 1801154.4 filed on Jan. 24, 2018, the entire contents of each of which are incorporated herein by reference.

BACKGROUND

This disclosure relates to a diving fin of modular construction. Divers often require fins with different types of foot pockets such as full-foot (for bare feet), open-heel (for use with dive boots) or even step-in (where a specially-configured shoe clips releasable onto a footplate) as well as different sized and shaped blades for different diving conditions and to meet personal requirements. This means that divers are often forced to own a number of sets of different fins and may battle to travel with multiple pairs due to luggage restrictions.

In addition, longer fin blade designs, which may have performance advantages in some conditions, are difficult to travel with due to their dimensions.

Furthermore, it may happen that either the foot pocket or the blade of a fin becomes damaged, while the rest of the fin is still in good condition. However, if the foot pocket and blade are integrated, the diver is forced to replace the entire fin, rather than just the damaged part.

Lastly, as a new fin blade design requires multiple sizes, tooling for the manufacture of traditional fins with integrated blade and foot pocket is also expensive. This is especially true if a manufacturer wishes to launch a new fin in both open heel and full foot styles, which could necessitate up to 12 large fin molds.

For these reasons, modular fins, whereby the foot pocket and blade are manufactured separately, are desirable.

However, although various modular fins and foldable fins have been developed, these fins all face various drawbacks, the most notable of which being that the connection between the foot pocket and the blade tends to be a weak point, and prone to breaking or disengaging under the load applied by the user's kick. In attempting to overcome this weakness, the connectors between the foot pocket and the blade of conventional modular fins and foldable fins tend to be very complex. In addition, despite being modular, many modular fins still require the manufacture of different sized blades for different sized foot pockets.

It is an object of this disclosure to provide a diving fin which, at least partially, alleviates some of the abovementioned problems.

In the following specification, the term "rail" is to be understood to mean a raised elongated projection, integral with the fin and extending along at least a portion of the foot pocket and the blade of the fin, for providing structural support and strength to the fin and longitudinal rigidity to both the blade and the foot pocket.

SUMMARY

In accordance with this disclosure there is provided a fin, comprising a blade and a foot pocket distinct from one another and releasably connected to one another by one or more rails extending from a leading edge of the blade to the foot pocket, wherein the rails extend from either side of the foot pocket and extend parallel to one another at least partway along the length of the blade towards a trailing edge of the blade, each rail comprising two sections; a first rail section, extending from the leading edge of the blade and terminating in a free end, and a second rail section extending from the foot pocket and terminating in a free end, such that the free end of one rail section includes a female recess, and the free end of the other rail section terminates in a male extension, slidably receivable in the female recess.

A transverse aperture located through the male extension, with corresponding apertures located through side walls of the female recess, in which the apertures are configured to align with one another when the male extension is inserted into the female recess.

A fastening element, such as a pin or plug may be insertable through the aligned apertures located in the female recess and the male extension, to secure the male extension within the female recess.

The foot pocket and the blade may be spaced apart from one another, and only connected to one another by the one or more rails.

The blade and foot pocket may be connected to one another by a pair of spaced apart rails extending substantially parallel to one another between the blade and the foot pocket.

The foot pocket may include a full foot, an open heel configuration, or a footplate for a step-in shoe.

Also described herein is a rail for a dive fin having a blade and a foot pocket, the rail being configured to releasably connect the blade and the foot pocket of the dive fin to one another, in which the rail includes a first rail section, extending from the leading edge of the blade and terminating in a free end, and a second rail section extending from the foot pocket and terminating in a free end, such that the free end of one rail section includes a female recess, and the free end of the other rail section terminates in a male extension, slidably receivable in the female recess.

The use of the rails as connectors facilitates the pairing of a variety of different size and style foot pockets with a variety of different size and design blades.

BRIEF DESCRIPTION OF THE DRAWINGS

The accompanying drawings are part of the disclosure and are incorporated into the present specification. The drawings illustrate examples of embodiments of the disclosure and, in conjunction with the description and claims, serve to explain, at least in part, various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein. Like numbers refer to like, but not necessarily the same or identical, elements throughout.

DETAILED DESCRIPTION

Figure 1:
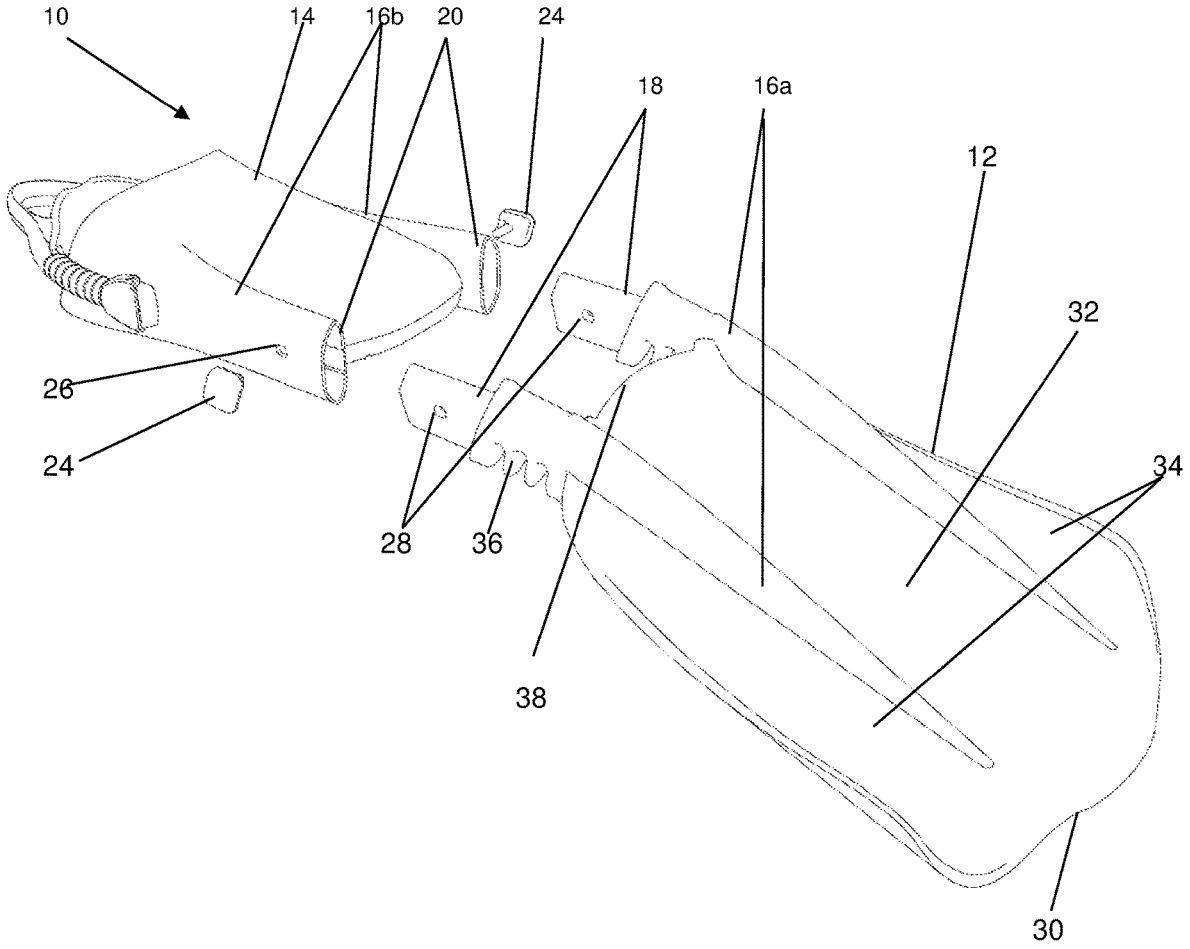
FIG. 1 is an exploded view of a fin, according to an embodiment.

Referring to FIGS. 1 to 4 in which like features are indicated by like numerals, the fin 10 includes a blade 12 and a foot pocket 14, distinct from one another and releasably connected to another by a pair of spaced apart rails 16 extending along the foot pocket 14 to the blade 12, and at least partway along the length of the blade 12.

It will be noted that even when connected, the foot pocket 14 and the blade 12 are spaced apart from one another by a gap 22 and only connected to one another by the rails 16.

Each rail 16 includes two sections, the first section 16*a* extending along at least a portion of the length of the blade 12 and terminating in a male extension 18 towards the foot pocket end of the blade, and the second rib section 16*b* extending along the length of the foot pocket 14 and terminating in a female recess 20 towards the toe end of the foot pocket. The male extension 18 of the first rail section 16*a* is slidably receivable in the female recess 20 of the second rail section 16*b* to provide an overlapping interface. This overlapping interface between the male 18 and female 20 rib sections provides a continuous structural element for joining the blade 12 to the foot pocket 14 and eliminates an identified weak point at the junction between the blade and the foot pocket.

As a result of this configuration, torque between the blade 12 and foot pocket 14 generated by drag on the fin blade during the diver's kicking motion does not act to separate the blade 12 from the foot pocket 14, as is the case with conventional systems. Furthermore, thrust generated by the blade 12 acts to force the male rail extension 18 further into the female recess 20, rather than trying to separate the two.

The male extension 18 is retained within the female recess 20 by one or more removable fastening elements comprising a pin or a plug 24, insertable through aligned apertures 26, 28 located in the walls of the female recess and through the body of the male extension. The pin or plug 24 serves to hold the male 18 and female 20 integers in place and does not bear any of the loads generated by the diver's kicking action. Additionally, as the fastening element 24 does not bear load, it can be configured so as to be easily removable by hand to facilitate quick disassembly of the fin for travel.

It will be noted that even when connected, the foot pocket 14 and the blade 12 are spaced apart from one another by a gap 22 and only connected to one another by the ribs 16. By eliminating any need for additional engaging devices between the foot pocket and the blade at the toe-end of the foot pocket, the disclosure provides for a modular fin which is hydrodynamic and avoids load at the toe-end of the foot, thus allowing for better power transfer from each kick and reduced fatigue and cramping of the foot during use of the fin. The extension of the ribs 16 into the foot pocket 14 of the fin, so that the ribs 16 are integral with the foot pocket 14 also provide rigidity to the foot pocket, preventing flex of the foot pocket 14 under load.

The rails 16 extend parallel to one another at least partway along the length of the blade 12 towards the trailing edge 30 of the blade.

Figure 2:
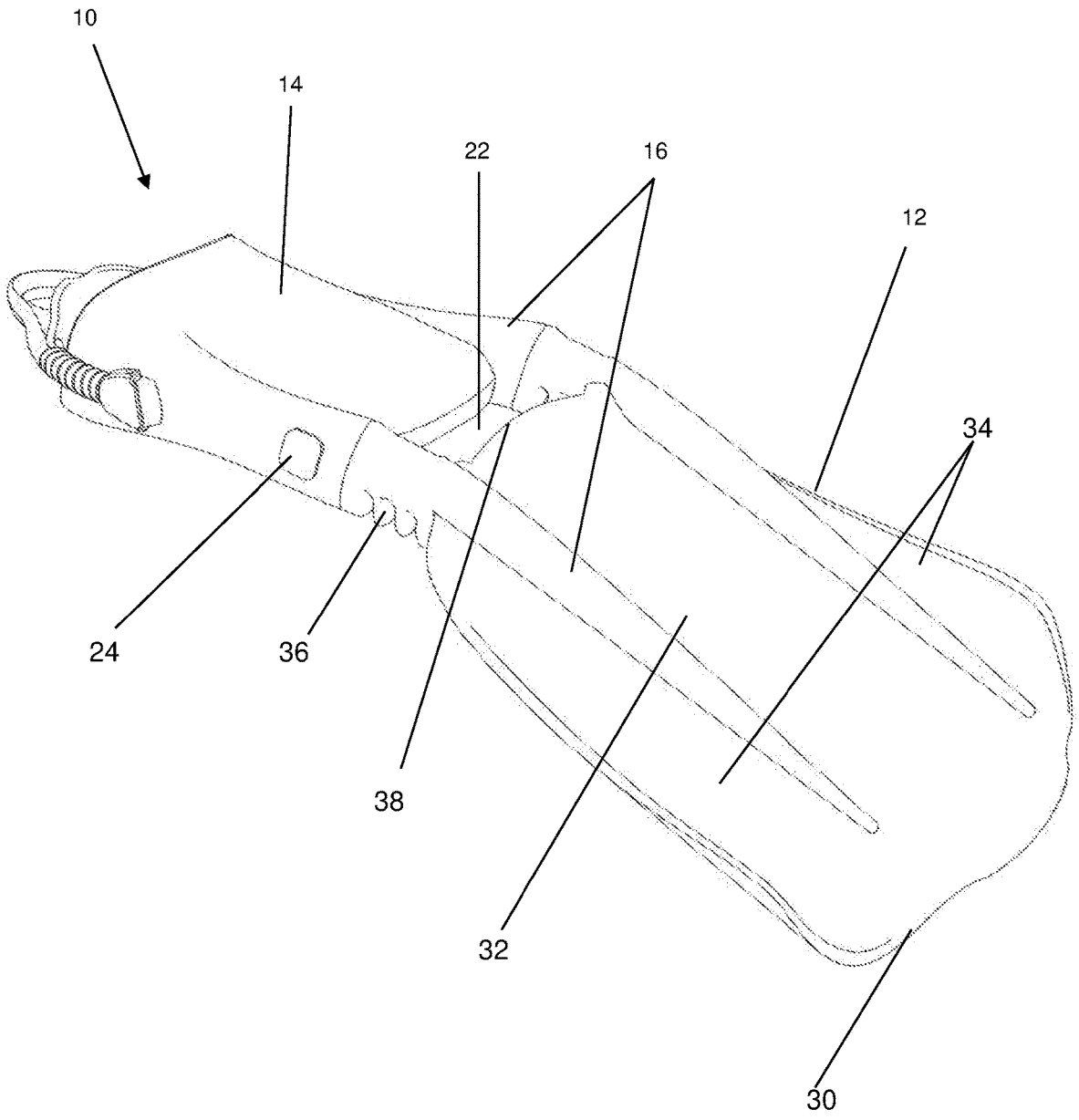
FIG. 2 illustrates perspective views of the fin when assembled, according to an embodiment.
Figure 3:
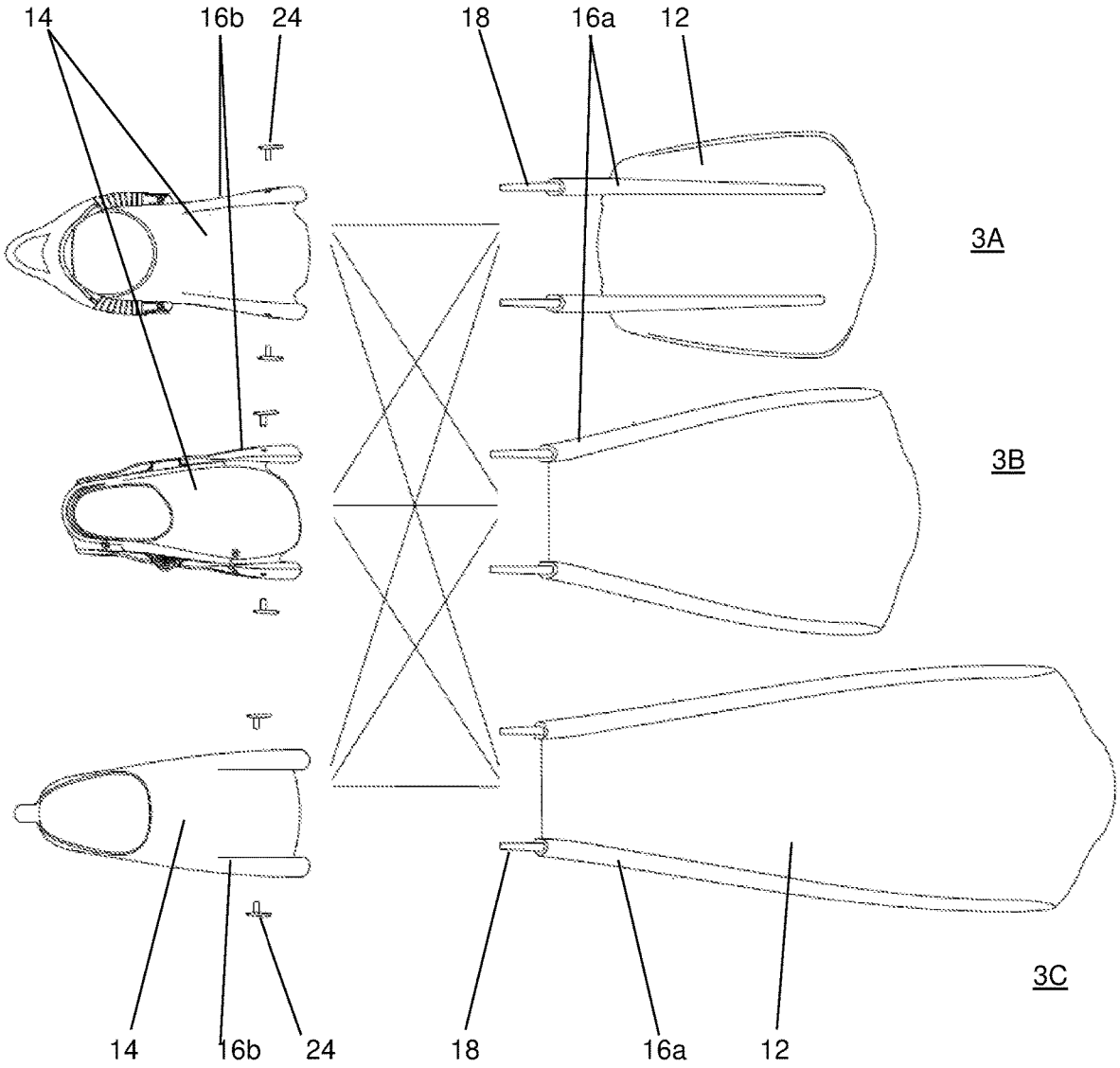
FIG. 3 is a plan view of various configurations of the fin, according to various embodiments.

Referring to FIGS. 1 to 3 it will be noted that the rails 16 can either extend through the body of the blade, such that the blade 12 is divided into three portions; a central portion 32, and two side wings 34. Alternatively, and referring to FIGS. 3B and 3C, the rails 16 can extend along the outer edges of the blade 12.

The rails may additionally include an articulated hinge 36 with limiting structures, located at the leading edge 38 of the blade.

Figure 4:
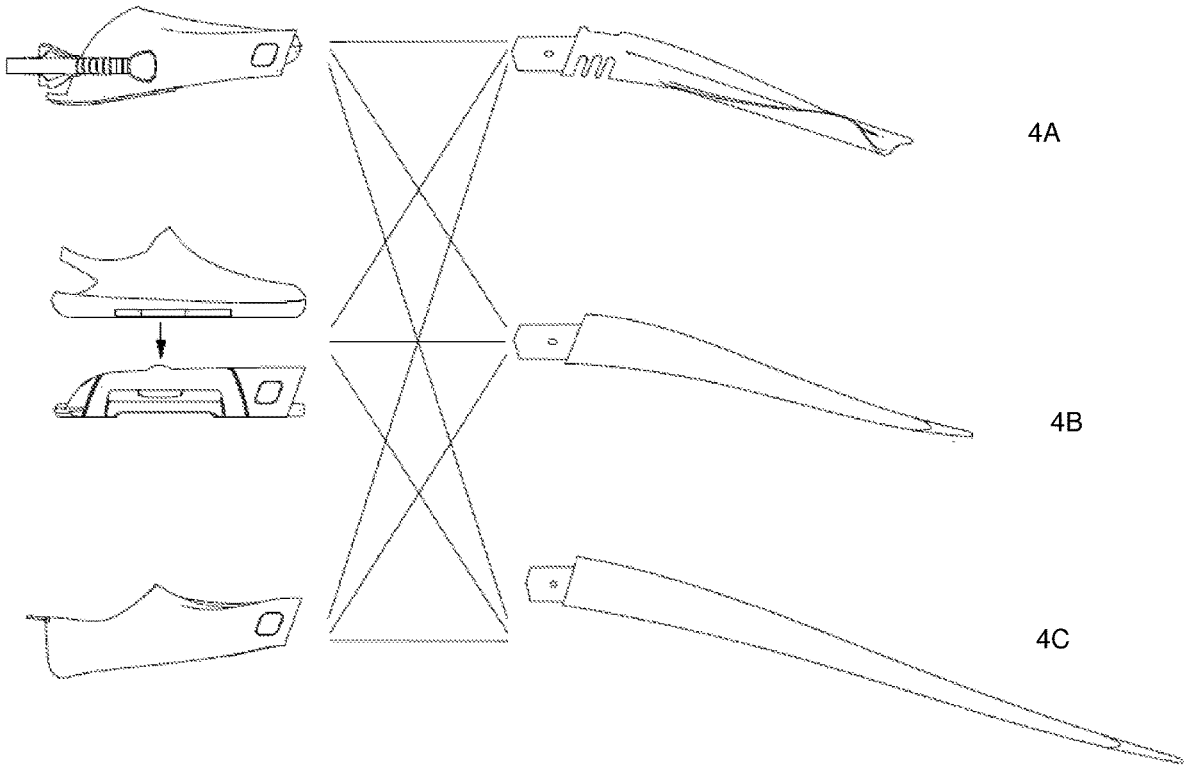
FIG. 4 is a side view of various configurations of the fin, according to various embodiments.

Referring to FIGS. 3 and 4 the foot pocket may be an open heel configuration (FIGS. 3A and 4A), a shoe (FIGS. 3B and 4B) or a full foot (FIGS. 3C and 4C), To assemble the fin 10, the male extension 18 of the first rail section 16*a* is inserted into the female recess 20 of the second rail section 16*b*, and is secured in place by the pin 24, inserted through the aligned apertures 26, 28. In this manner, the foot pocket 14 is connected to the blade 12, and the fin is ready for use.

To disassemble, one merely removes the pin 24, and slides the male extension 18 out of the female recess 20, disconnecting the foot pocket 14 from the blade 12, thus allowing the fin to take up less space during storage or travelling.

Referring to FIGS. 3 and 4, one big advantage of such a modular design, is that only one blade size is required for different sizes and styles of foot pocket. This dramatically saves in tooling and production costs. By employing a common rail dimension and spacing, every size and style foot pocket fits every blade size and design. This eliminates the complexity that would otherwise be involved in making a single blade size homogenously fit up to 12 different size and style foot pockets and, as a result, dramatically reduces the tooling costs of a new fin model (from up to 12 large fin mold down to a single new blade mold).

A further advantage of such a fin, is that the foot pocket and the blade can be manufactured separately and from different materials.

Furthermore, and referring again to FIGS. 3 and 4, a diver is able to interchange various foot pockets and blades depending on diving conditions and requirements. This results in a significant space saving, and makes the fins travel friendly.

The invention claimed is:

1. A dive fin, comprising a blade and a foot pocket distinct and spaced apart from one another and releasably connected to one another by only a pair of rails extending between the blade and the foot pocket, wherein the rails are integral with the foot pocket, extend along either side of the foot pocket towards a toe end of the foot pocket and extend parallel to one another at least partway along the length of the blade towards a trailing edge of the blade, each rail comprising two sections; a first rail section, extending from a leading edge of the blade and terminating in a free end, and a second rail section extending from the toe end of the foot pocket and terminating in a free end, in which the free end of one rail section comprises a female recess, and the free end of the other rail section comprises a male extension insertable into the female recess.

2. A dive fin as claimed in claim 1 in which a transverse aperture is located through the male extension, and corresponding apertures are located through side walls of the female recess, the apertures being configured to align with one another when the male extension is inserted into the female recess.

3. A dive fin as claimed in claim 2 in which a fastening element is insertable through the aligned apertures located in the female recess and the male extension, to secure the male extension within the female recess.

4. A dive fin as claimed in any one of claims 1 to 3 in which the foot pocket comprises any of a full foot, an open heel configuration, or a footplate for a step-in shoe.

* * * * *